US009700078B2

(12) United States Patent
Ampofo et al.

(10) Patent No.: US 9,700,078 B2
(45) Date of Patent: Jul. 11, 2017

(54) GARMENT WITH REMOVABLE AND INTERCHANGEABLE COMPONENTS

(71) Applicants: Andrew Ampofo, Irvington, NJ (US); Joana Ampofo, Irvington, NJ (US)

(72) Inventors: Andrew Ampofo, Irvington, NJ (US); Joana Ampofo, Irvington, NJ (US)

( * ) Notice: Subject to any disclaimer, the term of this patent is extended or adjusted under 35 U.S.C. 154(b) by 194 days.

(21) Appl. No.: 14/516,638

(22) Filed: Oct. 17, 2014

(65) Prior Publication Data

US 2015/0106995 A1 Apr. 23, 2015

Related U.S. Application Data

(60) Provisional application No. 61/893,211, filed on Oct. 19, 2013.

(51) Int. Cl.

| | |
|---|---|
| ***A41B 1/22*** | (2006.01) |
| ***A41D 15/00*** | (2006.01) |
| ***A41B 1/00*** | (2006.01) |
| *A41B 3/00* | (2006.01) |

(52) U.S. Cl.

CPC ..... *A41B 1/22* (2013.01); *A41B 1/00* (2013.01); *A41D 15/00* (2013.01); *A41B 3/00* (2013.01)

(58) Field of Classification Search

CPC ..... A41B 1/00; A41B 3/00
USPC ..... 2/115, 116, 119, 124
See application file for complete search history.

(56) References Cited

U.S. PATENT DOCUMENTS

| | | | | |
|---|---|---|---|---|
| 46,172 | A | 1/1865 | Wormser | |
| 285,046 | A | 9/1883 | Lemos | |
| 665,863 | A | 12/1900 | Auld | |
| 1,895,237 | A * | 1/1933 | Staw | A41D 1/02 2/116 |
| 2,382,907 | A | 6/1939 | Persin | |
| 2,508,732 | A * | 5/1950 | Summers | A41B 1/18 2/103 |
| 2,543,361 | A * | 2/1951 | Garner | A41B 1/00 2/119 |
| 2,556,039 | A | 6/1951 | Landert | |
| 3,116,491 | A | 1/1964 | Previdi et al. | |
| 3,230,547 | A | 1/1966 | Moran | |
| 3,984,876 | A | 10/1976 | Sutton | |

(Continued)

FOREIGN PATENT DOCUMENTS

| | | |
|---|---|---|
| EP | 334145 | 9/1989 |
| EP | 1095574 | 5/2001 |

(Continued)

*Primary Examiner* — Tejash Patel
(74) *Attorney, Agent, or Firm* — Gearhart Law LLC

(57) ABSTRACT

Interchangeable component(s) can be paired with an existing garment to create the illusion of multiple fashion ensembles without bearing the prohibitive cost or discomfort of such clothing to the user. The interchangeable components can be lengths of garment coverings, collars, cuffs, or any combination thereof. These interchangeable components can be removably affixed to a garment via any number and type of fastening mechanisms. This enables a wearer to create many different styles of patterns and colors without the purchase of a completely new garment. Additionally, an illusion of a wearer wearing certain styles of clothing can be achieved while removing uncomfortable fabrics and items often necessitated by such styles.

13 Claims, 7 Drawing Sheets

(56) References Cited

U.S. PATENT DOCUMENTS

| | | | | | |
|---|---|---|---|---|---|
| 3,997,982 | A | * | 12/1976 | Holland | G09B 25/00 2/102 |
| 4,494,248 | A | | 1/1985 | Holder | |
| 5,774,892 | A | | 7/1998 | Tidale et al. | |
| 5,864,879 | A | | 2/1999 | Bercane | |
| 7,028,342 | B1 | | 4/2006 | Nordstrom et al. | |
| 2006/0048262 | A1 | | 3/2006 | Sencion | |
| 2009/0222970 | A1 | | 9/2009 | Coleman | |
| 2013/0326788 | A1 | | 12/2013 | Bell | |

FOREIGN PATENT DOCUMENTS

| | | |
|---|---|---|
| GB | 2387761 | 10/2003 |
| WO | 2005009153 | 2/2005 |

* cited by examiner

GARMENT WITH REMOVABLE AND INTERCHANGEABLE COMPONENTS

CLAIM OF PRIORITY

This application claims priority to U.S. Provisional Application Ser. No. 61/893,211 filed on Oct. 19, 2013, the contents of which are fully incorporated by reference in its entirety.

FIELD OF THE EMBODIMENTS

This field of the invention and its embodiments relate to a garment that can be worn for various social occasions, namely a garment to be worn where only a portion of the garment is exposed. In particular, the present invention relates to a shirt that has a removable and interchangeable or permanent central panel thereby modifying the style or look of the shirt.

BACKGROUND OF THE EMBODIMENTS

In today's society it is widely acceptable and fashionable for suits as well as many other types of outer garments (i.e. garments worn over other garments) to be worn over collared and/or cuffed shirts. These shirts can be further mixed and matched with trousers and other clothing accessories of all colors.

Wearing a suit, pullover, and the like over a dress shirt may give one a professional appearance and is usually considered formal attire. Hence, such formal clothing is mostly seen the work environment, places of worship, and the like. However, when one wears a suit or the like over a dress shirt, most of the dress shirt is not visible as it lies covered by the suit. Some exceptions are for the space in between the two lapels of a suit and the cuffs of the shirt.

In some types of outer garment like jackets, vests, over coats and suits, the dress shirts is visible in the space in between the two plackets especially when they are opened by unbuttoning or unzipping the plackets. In the case of sweaters or pullovers worn over dress shirts, the visible part of the shirt is mostly around the collar area.

However, there are drawbacks to these fashion styles as many people find sweaters, suits, and the like to be uncomfortable. They can be hot and bulky which contributes to people's discomfort. Additionally, many formal types of clothing can be expensive. Suits and other trendy clothing can often costs hundreds or even thousands of dollars for one outfit. Multiple outfits are often required for the workplace and other functions.

Thus, there needs to be a garment which can comfortably be worn under formal attire and be worn with a number of colors and fashions of outer garments. Additionally, such a garment should be adaptable to create the illusion that certain types of clothing is being worn. The present invention and its embodiments meets and exceeds these objectives.

REVIEW OF RELATED TECHNOLOGY

U.S. Pat. No. 4,494,248 pertains to a garment made from garment portions detachably attached together and inserts selectively added thereto for enlarging the garment as needed.

U.S. Pat. No. 3,230,547 pertains to an accessory for a wearer trying on suits of clothing, more particularly, to an accessory for simulating a dress shirt and neck tie to enable a wearer to visualize how a particular suit of clothes looks with shirts and neck ties of various colors.

U.S. Patent Application 2013/0326788 pertains to an undergarment, such as a corset, adapted to be worn about a torso of a wearer includes a body having first longitudinal edges. A separate panel is removably attached to the first longitudinal edges of the body. The separate panel can be replaced by another separate panel which has a different design, coloring, or material construction. The body may be formed of first and second separate body members which also are secured along second longitudinal edges by adjustable lacing.

U.S. Patent Application 2009/0222970 pertains to a tee shirt, polo type shirt and/or garment of simple design that can quickly, easily and selectively be changed into an innovative, versatile garment by alternating, reversing and/or interchanging extensions that consist of but not limited to cuffs, collars and layers that attaches by various means to necklines, tubular sleeves, waist or waistlines changing a garment of simple design into an innovative garment that is more versatile, more flexible, more adaptable and more purposeful, for a variety of situations, activities and/or requirements.

International Application WO2005/009153 pertains to collars and cuffs detachable from shirt neckbands or shirt sleeves respectively, for use by men and women, and replaceable by spares manufactured in fabrics of several patterns, colors, and shapes. The collars and cuffs are fixed by Velcro® bands or plastic/metal pressure buttons into their respective counter parts, that means Velcro® bands or buttons. The used collars and cuffs can be easily cleaned and washed independently of the whole shirt and put as spares.

Europe Patent EP1095574 pertains to an improved garment characterized essentially because it is formed from a garment such as a shirt, t-shirt, or blouse which presents two longitudinal parallel openings centered in the front, creating a space which is filled by an interchangeable central part, attached by means of zip fasteners.

As described, various devices are known in the art. However, their structure and means of operation are substantially different from the present disclosure. The present invention and its embodiments provide for a garment with a permanent or removably coupled length of material adhered thereto. Additional collars and cuffs can be used to create a particular look or style. At least one embodiment of this invention is presented in the drawings below and will be described in more detail herein.

SUMMARY OF THE EMBODIMENTS

A fashion system is described and taught having a length of material having a first longitudinal edge and a second longitudinal edge, at least one interchangeable component; and at least one garment, wherein the garment is adapted to receive the least one interchangeable component.

In another embodiment of the invention there is a fashion system with a garment covering having a length of material having a first longitudinal edge and a second longitudinal edge, wherein the length of material is configured to be disposed on a front of a garment, a plurality of buttons disposed along the length of material; a collar structure disposed on one end of the length of material, wherein the collar structure is removable; at least one cuff structure; and at least one garment, wherein the at least one garment is adapted to receive the garment covering, the at least one cuff structure, and the collar structure or any combination thereof.

In another aspect of the invention there is a kit to accessorize a garment having at least one length of material having a first longitudinal edge and a second longitudinal edge, wherein the length of material is configured to be disposed on a front of the garment; and at least one interchangeable component capable of being removably attached to the garment and/or the length of material.

Generally, the present invention and its embodiments provide for a fashion system with interchangeable pieces or components that can be worn with other clothing items. The fashion system preferably has a length of material in the form of a section of a button down or dress shirt. This section is sized to be visible between the lapels of a suit coat or sport jacket or the like and provide the illusion of the wearer having a full button down shirt.

Additionally, the length of material may accommodate a collar structure that can be attached to one end of the length of material. Cuff structures may also be coupled to the underlying garment to further enhance one's visible appearance. The underlying garment is typically a tee shirt or long sleeved shirt. Each of the components is capable of being coupled to the garment by way of a fastening mechanism such as a hook and loop fastener.

Differing colors and styles of these components can be mixed and matched to create the illusion of an extensive wardrobe when, in reality, the interchangeable components are creating this appearance. This is particularly helpful for those on a budget or who find that the bulk and fabric typical of such clothing to be unbearable.

In general, the present invention succeeds in conferring the following, and other not mentioned, benefits and objectives.

It is an object of the present invention to provide a fashion system that has interchangeable parts or components.

It is an object of the present invention to provide a fashion system that creates the appearance of wearing formal attire.

It is an object of the present invention to provide a fashion system that is comfortable.

It is an object of the present invention to provide a fashion system that is affordable.

It is an object of the present invention to provide a fashion system that is economical and uses less fabric than conventional garments.

It is an object of the present invention to provide a fashion system that can be worn as an undershirt.

It is another object of the present invention to provide a fashion system that can create multiple styles or looks with a minimal amount of different clothing items.

It is another object of the present invention to provide a fashion system that is easy to use and customize.

It is yet another object of the present invention to provide a fashion system that can be worn with a variety of styles of colors of clothing.

DESCRIPTION OF THE PREFERRED EMBODIMENTS

Figure 1A:
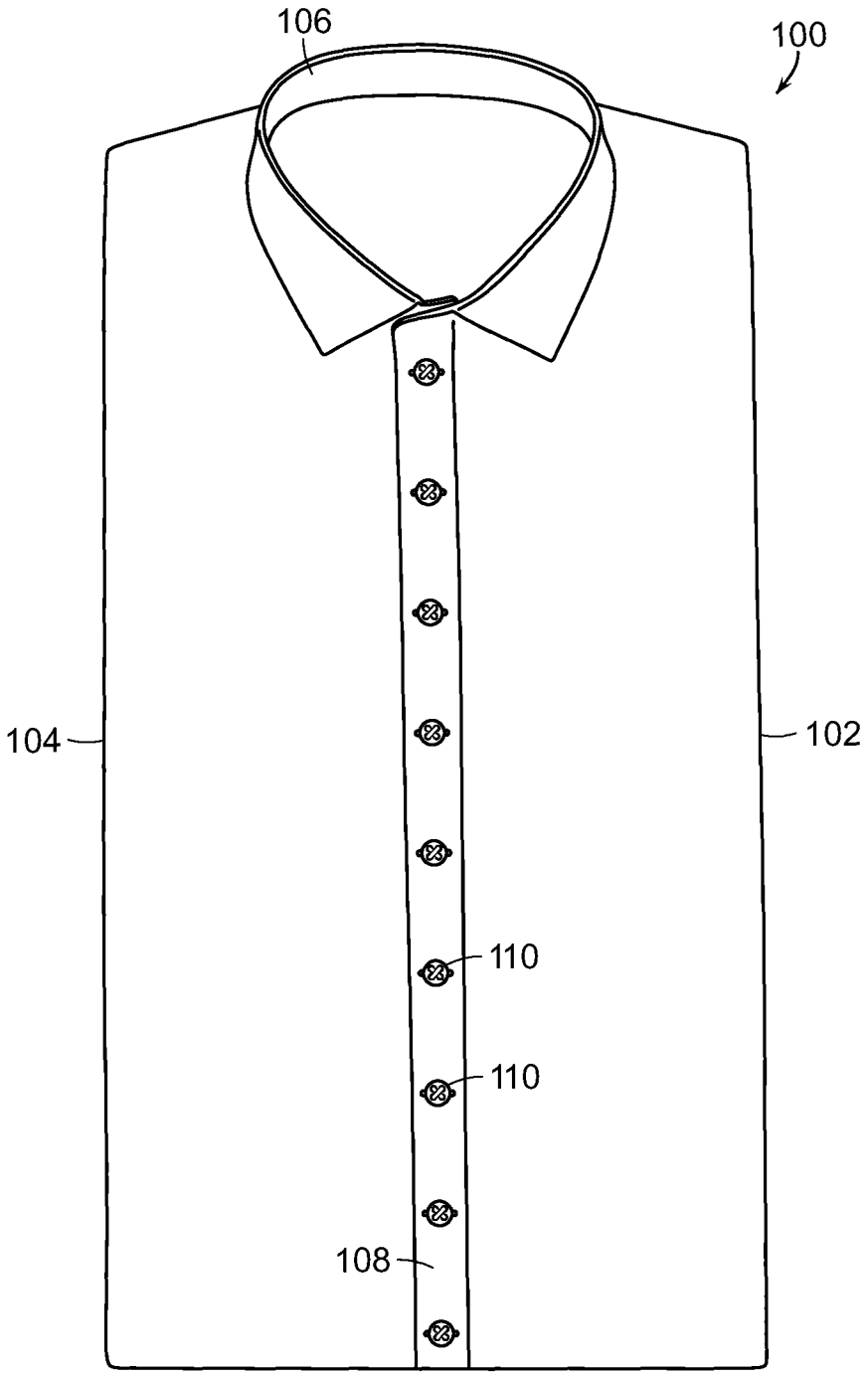
FIG. 1A is a front view of one example of length of material in accordance with the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
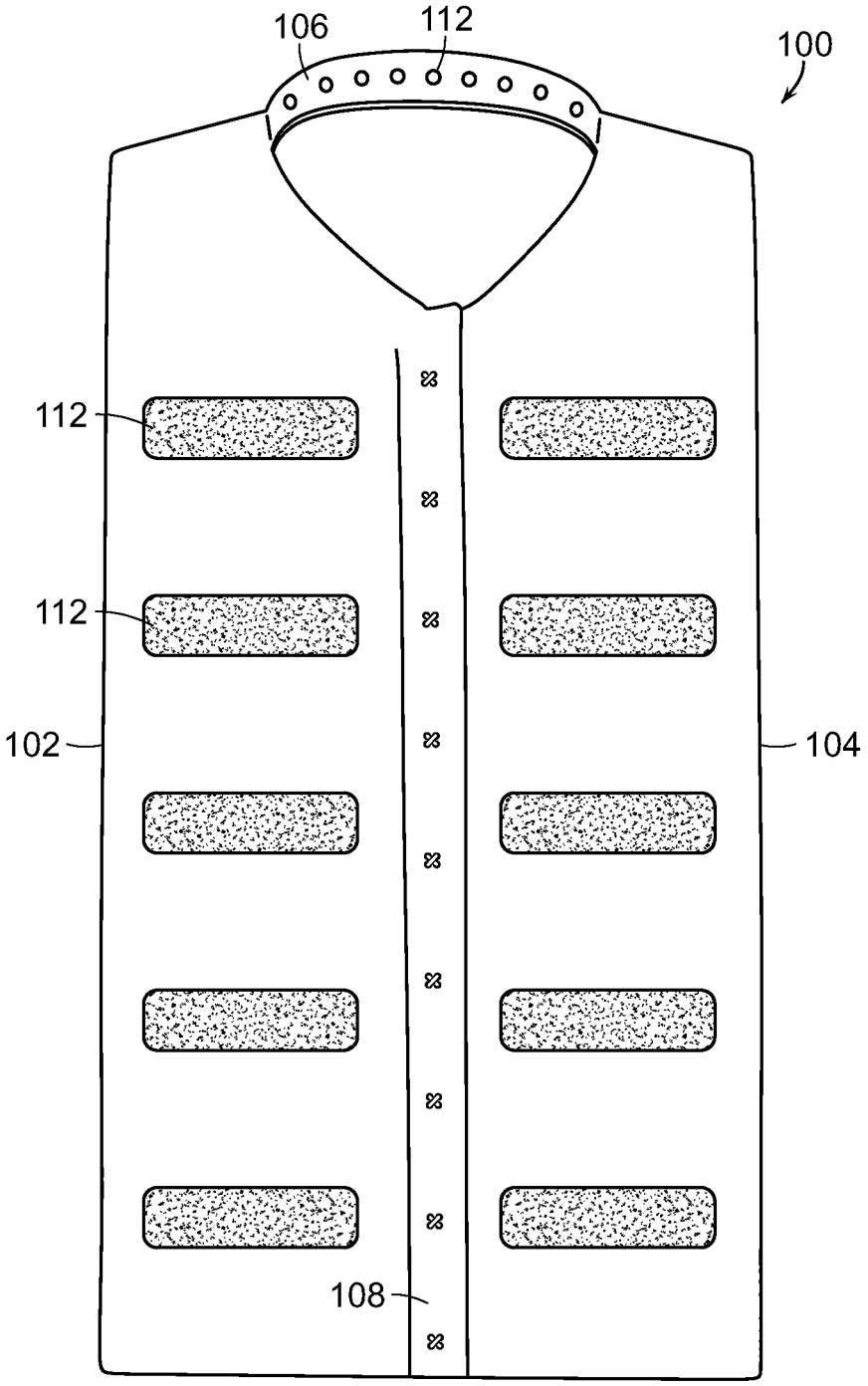
FIG. 1B is a back view of the length of material shown in FIG. 1.

Referring now to FIGS. 1A and 1B, there is a length of material 100 in the form of a section of an article of clothing or garment. The length of material has a first longitudinal edge 102 and a second longitudinal edge 104. A button strip or area 108 is provided down the middle of the length of material 100. The button strip 108 has a number of buttons 110 attached thereto. On one end of the length of material 100 there is a collar structure 106 attached thereto. The collar structure 106 may be removable from the length of material 100 and further has a plurality of fastening mechanisms 112 attached thereto.

On one side of the length of material 100, there are a plurality of fastening mechanisms 112 disposed thereon as shown in FIG. 1B. These fastening mechanisms 112 may take a variety of forms including hooks, zippers, snaps, buttons, hook and loop fasteners, and the like or any combination thereof. The fastening mechanism 112 enables the length of material 100 to be coupled to any garment capable of receiving the length of material 100 thereon (see FIG. 2).

The length of material 100 may bear any color, style, pattern, insignia, logo, characters and the like or any combination thereof. The horizontal distance, that is, the length from the first longitudinal edge 102 to the second longitudinal edge 104 is sized to cover the distance between the lapels of a suit coat, sport coat, or other similarly situated item (see FIG. 6). This distance may vary depending on the intended usage and the garment to be worn over the garment the length of material is coupled to.

Figure 2:
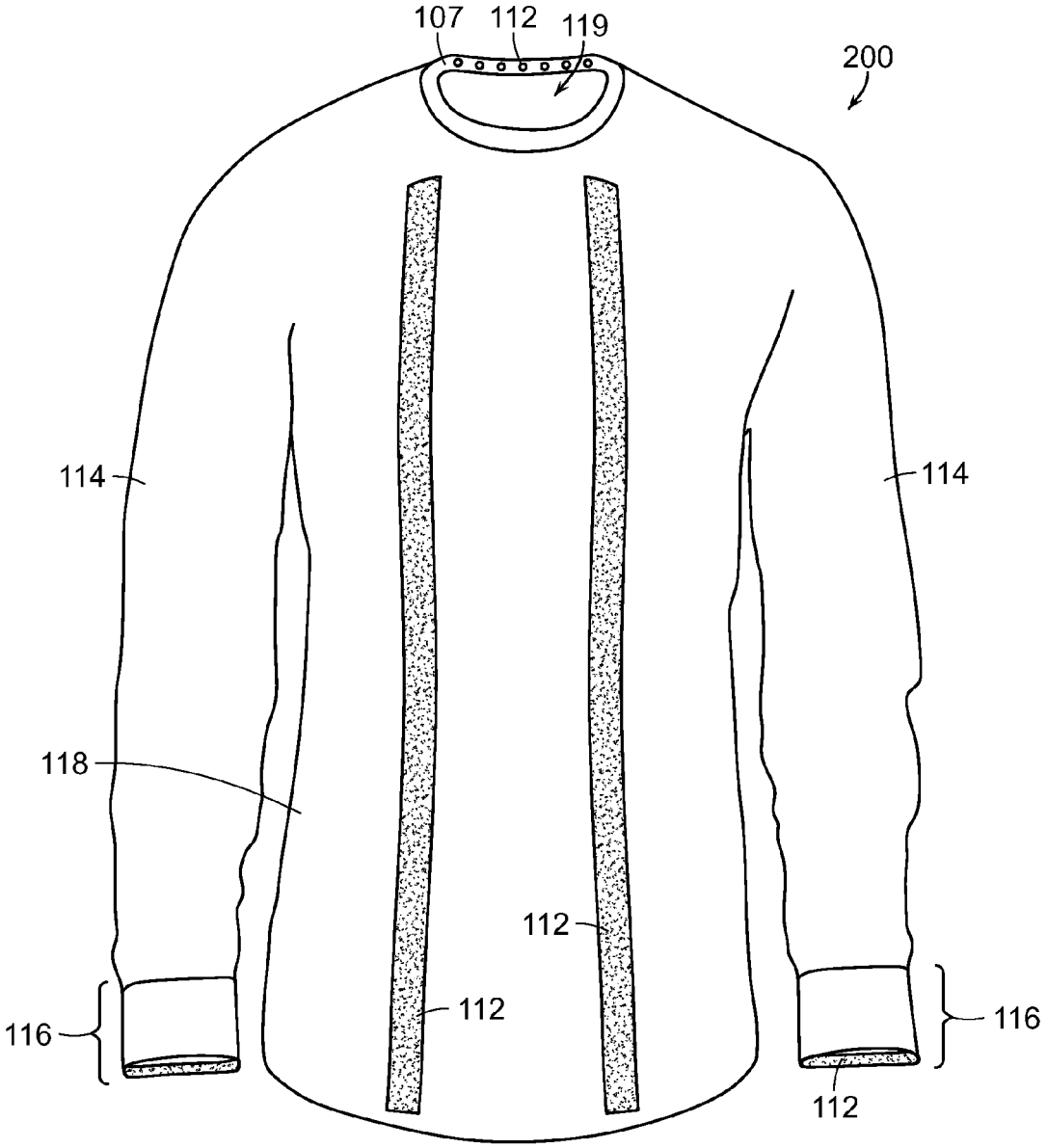
FIG. 2 is a front view of a garment to be used with the present invention.
Figure 4:
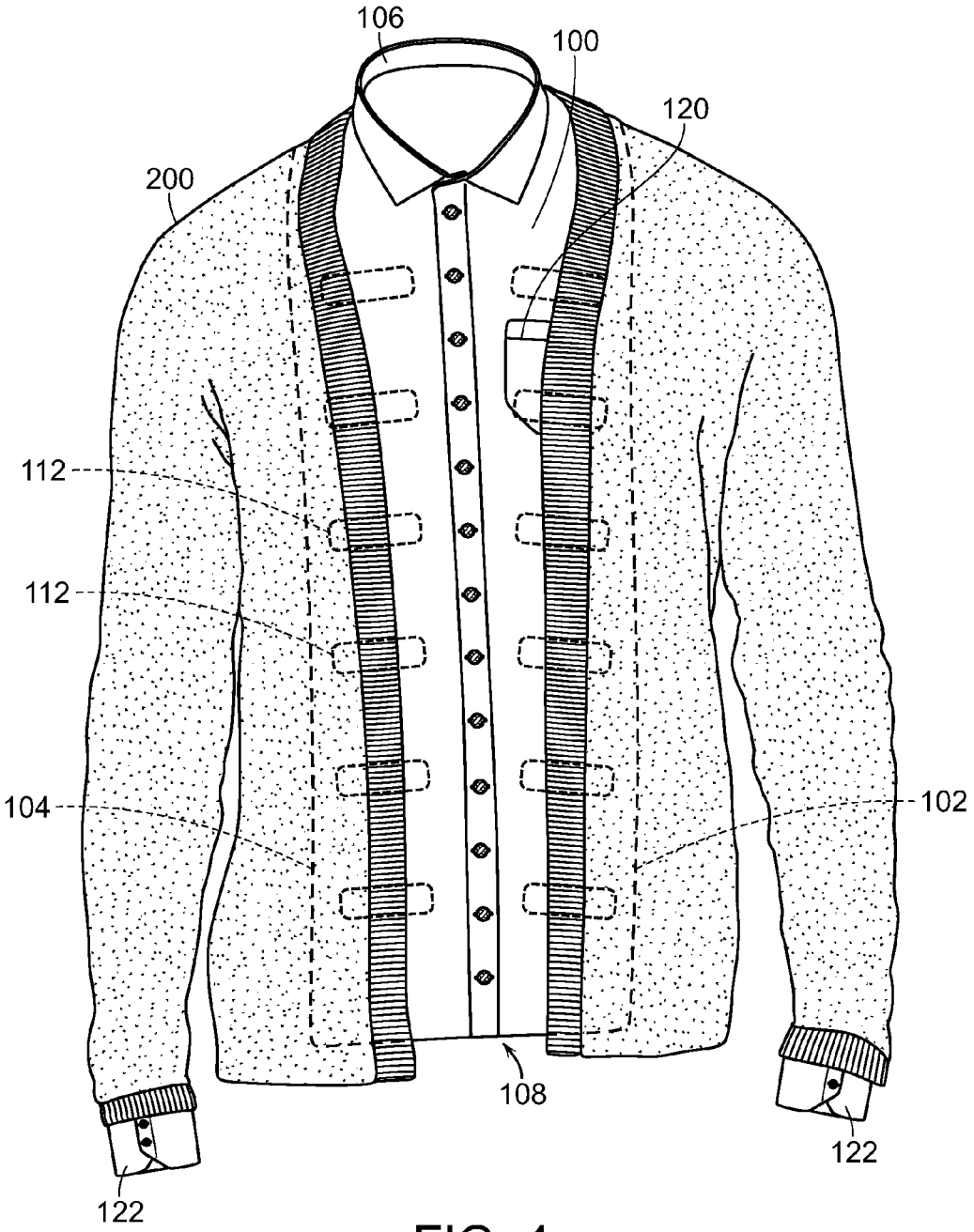
FIG. 4 is an example of a length of material adhered to a garment.

FIG. 2 shows a garment 200 adapted to receive a length of material as shown in FIGS. 1A and 1B as well as a cuff structure as shown in FIG. 4. The garment 200 has a body area 118 to fit around the chest/torso of a person. Preferably, the garment has two sleeves 114, although the sleeves 114 are not imperative for use with the components described herein.

On the body area 118 of the garment 200 there are fastening mechanisms 112. These fastening mechanisms should be complementary to those on the length of material 100 shown in FIG. 1B. The fastening mechanisms 112 may be disposed on the surface of the garment 200 in a number of orientations and these orientations may be dependent on the orientation of the fastening mechanisms 112 of the length of material.

A collar 107 may be present around the neck area 119 of the garment 200. The collar 107 may be a raised or have a height in relation to the garment 200 to provide a surface for supporting the collar structure 106 as shown in FIG. 4. Alternatively, the collar 107 may be substantially flat and have a number of fastening mechanisms 112 attached thereto. These fastening mechanisms 112 are used to couple the collar 107 to the collar structure 106 (see FIG. 1B).

The sleeves 114 terminate in a cuff area 116. The cuff area 116 may have a fastening mechanism disposed thereon for attachment of a cuff structure 116 as shown in FIG. 3 to be attached thereto.

Figure 3:
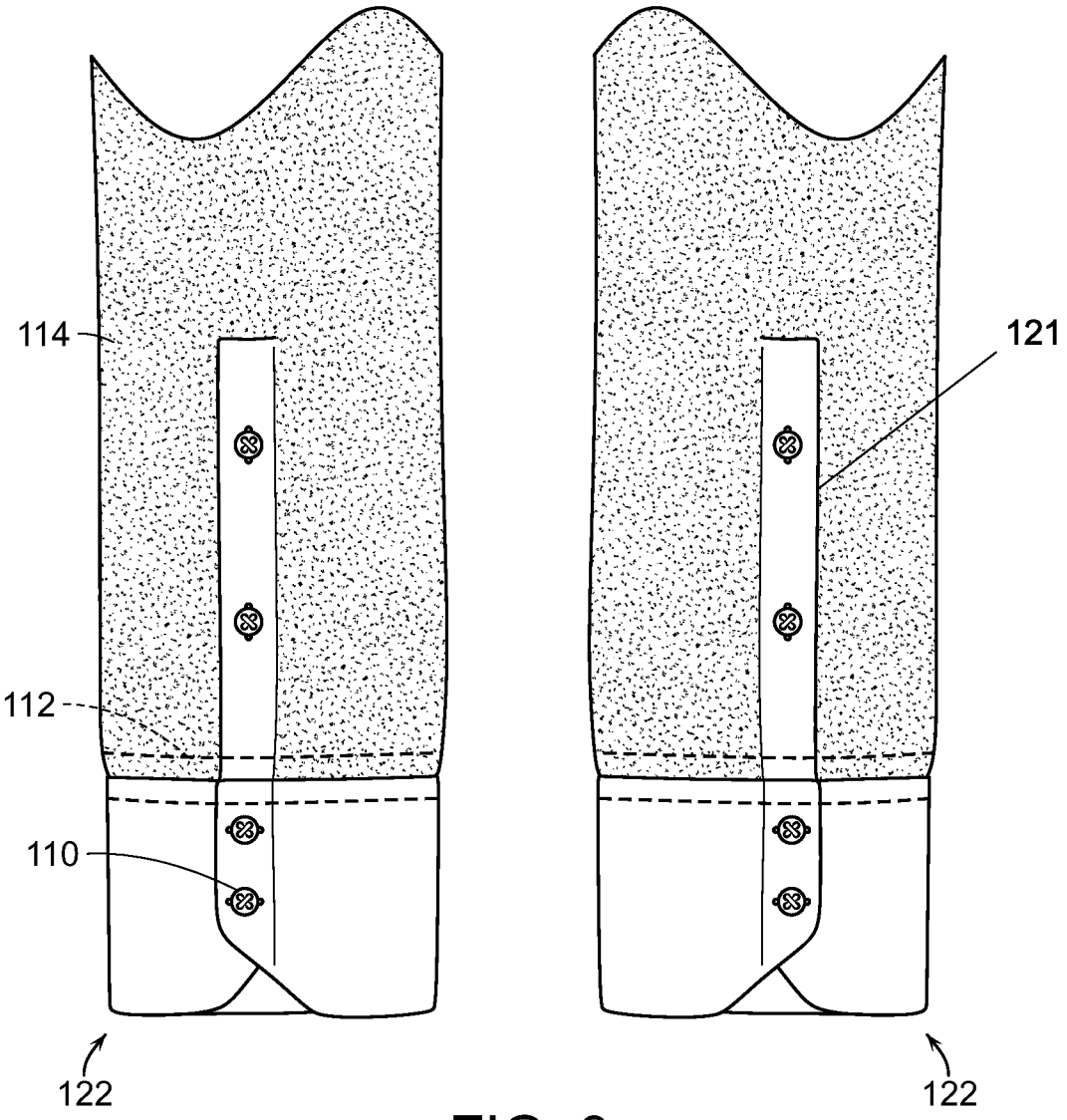
FIG. 3 is an example of a cuff structure being attached to a sleeve of a garment.

Referring now to FIG. 3, there is an example of a cuff structure 122 adhered to a sleeve 114 of a garment. The cuff structure 122 may have a cuff strip 121 attached thereto.

The cuff structure 122 is attached to the garment via a fastening mechanism 112 which may be a hook and loop fastener. The fastening mechanism 112 may be disposed on both the cuff structure 122 and the sleeve 114 of the garment. In some instances, there may be no sleeve for attachment and the cuff structure 122 may need to attach directly to an outer garment. Further, buttons 110 enhance the look of the cuff structure 122 lending towards its natural appearance on a typical cuff bearing garment.

In FIG. 4, there is a garment 200 with the length of material 100 and cuff structures 122 attached thereto. The length of material 100 is centrally located on the garment 200 and adhered via a fastening mechanism 112. The first longitudinal edge 102 and the second longitudinal edge 104 are spaced to provide sufficient space to cover a substantial portion of the garment 200. A button down area 108 has a number of buttons 110. The buttons 110 may be functional (i.e. can be buttoned or unbuttoned) to increase the versatility of the length of material 100. Alternatively, the buttons 110 may be merely decorative.

A partial pocket 120 may appear on part of the length of material 100 to present the illusion of a pocket 120. The pocket 120 may be removable. The collar structure 106 is positioned at one end of the length of material and may be attached via a fastening mechanism or may be integral with the length of material.

Figure 5:
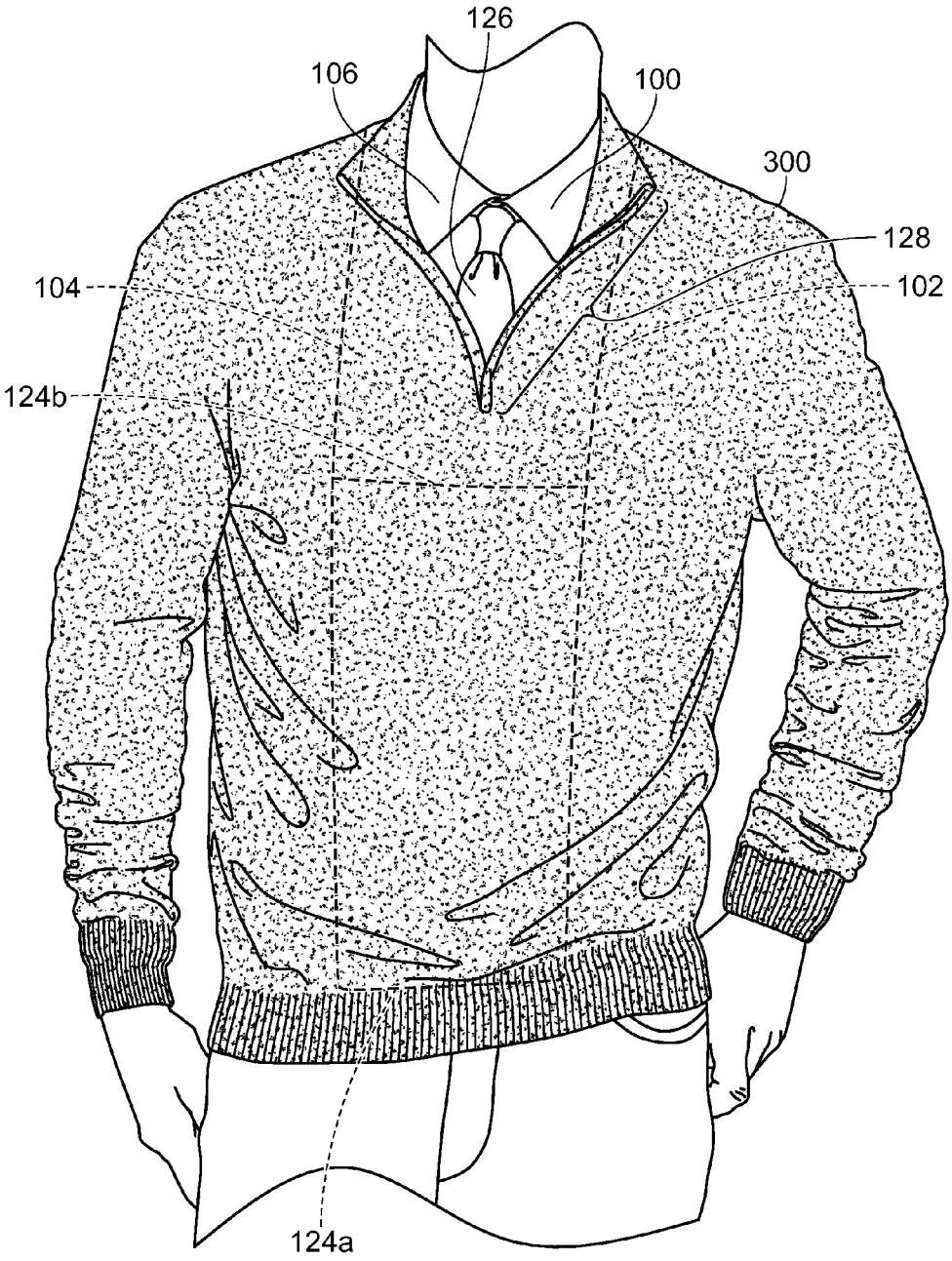
FIG. 5 is an example of a sweater with a partial zip being worn with the present invention coupled thereto giving the appearance of a unitary ensemble.
Figure 6:
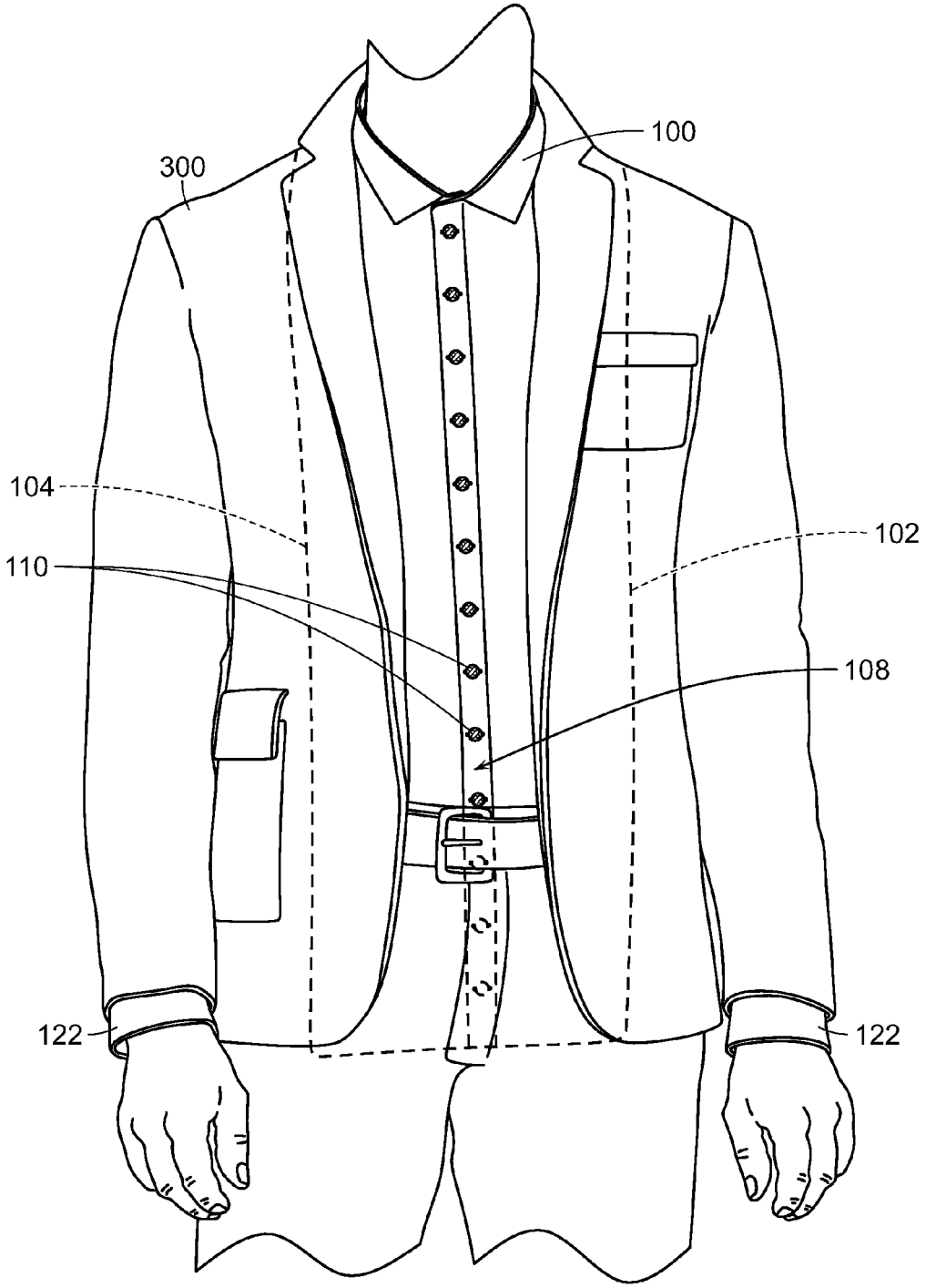
FIG. 6 is an example of a second garment being worn over a garment with bearing the present invention coupled thereto giving the appearance of a unitary ensemble.

Referring now to FIGS. 5 and 6, there are two examples of how the length of material 100 may be adhered to a garment 200 and worn under an outer garment 300. Alternatively, as shown, the garment 200 and the length of material 100 may be permanently adhered to one another and require no fastening mechanism as described in FIG. 4. In each instance, the length of material 100 is partially obscured by the outer garment 300. Since the length of material 100 is partially obscured by the outer garment 300, the dimensions of the length of material 100 can vary.

In FIG. 5, for example, the length of material 100 is partially exposed by the unzipped area 128. This exposes only the roughly top third of the length of material 100. The first longitudinal edge 102 and the second longitudinal edge 104 are obscured by the outer garment 300. As such, the length of material 100 may have a bottom edge 124*a* that extends down to the waist area of a wearer or may have a bottom edge 124*b* as denoted. This further decreases the amount of fabric or fastening mechanism required for a particular style.

In this case, the first longitudinal edge 102 and the second longitudinal edge 104 are permanently coupled to the garment 200. This coupling may be done with stitching, glues and other permanent adhesives, and the like or any combination thereof. In such an embodiment, the collar 106 may also be permanently coupled to the length of material 100.

A tie 126 may be worn with the ensemble and positioned around the collar structure 106. The tie 126 may be a full length tie or may be shortened in conjunction with the length of material 100. The actual length of the tie 126 can vary, the determinative measure for the length of the tie is to be the amount (length) of the tie that is to be exposed. As the outer garment 300, is a zip up sweater style of clothing, less of the length of material 100 and any associated structures are seen.

In FIG. 6, the outer garment 300 takes the form of what may be commonly referred to as a sport coat or suit coat. The first longitudinal edge 102 and the second longitudinal edge 104 are shown in a dashed format underneath the outer garment 300. There should be some distance of the garment 200 covered by the length of material 100 in excess in relation to the outer garment 300. This prevents inadvertent shifting of the outer garment 300 thereby exposing the garment 200 rather than the length of material 100.

The button area 108 and buttons 110 lend credence to the actual wearing of a button down or similarly situated shirt underneath the outer garment 300 when in reality there is only the length of material 100 primarily defined by the first longitudinal edge 102 and the second longitudinal edge 104. Additionally, in this configuration the cuff structures 122 are visible. The cuff structures 122, being removable, may be worn or removed with any particular style of clothing being worn at any particular time. As such, the cuff structures 122 are not being worn in FIG. 5, but are prominent in FIG. 6. The cuff structures 122 may also be permanently coupled to the garment 200 in the manner described above pertaining to the length of material 100. While this does provide for some decreased flexibility in mixing and matching of items, it does prevent the separation of items (i.e. cuff from garment) during the course of use.

The outer garment 300 has been shown for exemplary purposes only, and any number, type, size, and so forth of garment may be worn in conjunction with the present invention.

The length of material 100, collar structure 106, and cuff structures 122 may generally comprise any number of textiles including woven or unwoven fabric, cloth, terry-cloth, woven or woven fibers of wool, flax, cotton, and/or yarn, mineral textiles, and synthetic textile including but not limited to nylon, polyester, and/or acrylic, or any combinations thereof. The material may be the same or different between the individual components of the present invention and further so when paired with other articles of clothing to create an ensemble or particular fashion statement. As noted, there may be other items to be included within the scope of this invention to further complete a particular appearance including ties, tie tacks, cuff links, buttons, snaps, clips, and the like or any combination thereof.

Further, any of the above is not relegated to formal wear, but may comprise any article(s) of clothing employing the concepts described herein. For example, if a particular garment 200 is worn with a suit coat the appearance is different than if it is worn with a sweater. It may be practical to have a long sleeve t-shirt and have a light jacket or windbreaker that fits over the long sleeve t-shirt. The possibilities are virtually innumerable.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A fashion system comprising:

a length of material having at least a first longitudinal edge, a second longitudinal edge, and a first fastening mechanism disposed on a rear surface of the length of material;

at least one interchangeable component having a second fastening mechanism, wherein the at least one interchangeable component is at least one collar and at least one cuff, wherein the second fastening mechanism is disposed on a rear surface of the at least one collar and an inner surface of the at least one cuff; and a garment having fastening mechanisms disposed thereon that are complimentary to each of the first fastening mechanism and the second fastening mechanism, wherein the garment is adapted to removably receive the at least one interchangeable component via the second fastening mechanism, and wherein the garment is adapted to removably receive the length of material via the first fastening mechanism.

2. The fashion system of claim 1 further comprising a second garment configured to be worn over the garment.

3. The fashion system of claim 1 wherein the first fastening mechanism is a hook and loop fastener.

4. The fashion system of claim 1 wherein the wherein at least one of the fastening mechanisms of the garment is disposed on an outer front surface of the garment.

5. The fashion system of claim 1 wherein the at least one cuff is coupled to a sleeve of the garment.

6. A fashion system comprising:

a garment covering comprising, a length of material having at least a first longitudinal edge and a second longitudinal edge, a plurality of buttons disposed on a front surface of the garment covering, and a first fastening mechanism disposed on a rear surface of the garment covering;

a collar structure disposed on a first end of the garment covering, wherein the collar structure has a second fastening mechanism disposed on an inner surface thereof;

at least one cuff structure having a third fastening mechanism disposed thereon; and at least one garment having complimentary fastening mechanisms disposed thereon and being configured to couple to the first fastening mechanism, the second fastening mechanism, and the third fastening mechanism, wherein the at least one garment is adapted to removably receive the garment covering on an outer front surface of the at least one garment, the at least one cuff structure at an end of at least one sleeve of the at least one garment, and the collar structure at a collar of the at least one garment, or any combination thereof.

7. The fashion system of claim 6 wherein the garment covering further comprises a pocket structure.

8. The fashion system of claim 6 wherein there are two garments with one garment being worn over the other garment and the garment covering, at least one cuff structure, and collar structure being coupled to the garment worn below the other garment.

9. The fashion system of claim 6 wherein any number of garment coverings, cuff structures, and collar structures can be worn with one another.

10. The fashion system of claim 6 wherein the at least one garment has a raised collar to support the collar structure.

11. The fashion system of claim 6 wherein the first fastening mechanism is a hook and loop fastener.

12. A kit to accessorize a garment, the kit comprising:

at least one length of material having at least a first longitudinal edge, a second longitudinal edge, and a first fastening mechanism disposed on a rear surface of the at least one length of material, wherein the at least one length of material is configured to be coupled to a complimentary coupling mechanism disposed on a front surface of the garment; and a plurality of interchangeable components configured to be removably attached to the garment and the at least one length of material, wherein the plurality of interchangeable components comprises at least one cuff structure and at least one collar structure.

13. The kit component of claim 12 wherein the at least one collar structure is configured to be disposed on a first end of the at least one length of material.

* * * * *